US005963182A

United States Patent [19]

Bassily

[11] Patent Number: 5,963,182

[45] Date of Patent: Oct. 5, 1999

[54] EDGE-SUPPORTED UMBRELLA REFLECTOR WITH LOW STOWAGE PROFILE

[76] Inventor: Samir F. Bassily, 6127 W. 74th St., Los Angeles, Calif. 90045

[21] Appl. No.: 08/888,762

[22] Filed: Jul. 7, 1997

[51] Int. Cl.[6] ..... H01Q 15/20

[52] U.S. Cl. ..... 343/912; 343/915; 343/881; 343/882

[58] Field of Search ..... 343/915, 912, 343/840, 916, 913, 914, 721, 894; H01Q 15/20

[56] References Cited

U.S. PATENT DOCUMENTS 5,870,060 2/1999 Chen et al. ..... 343/781 R

*Primary Examiner*—Robert H. Kim
*Assistant Examiner*—Layla Lauchman
*Attorney, Agent, or Firm*—Terje Gudmestad; Georgann Grunebach; Michael W. Sales

[57] ABSTRACT

An umbrella-like antenna reflector assembly for use on an orbiting spacecraft. The reflector has a main rib and a plurality of secondary ribs each connected to a hub assembly by a respective hinge mechanism such that activation of the hub assembly causes the reflector to move between collapsed and opened configurations. The reflector further has a mesh member attached to the ribs. A deployment boom connects the main rib of the reflector to the spacecraft. The deployment boom is operable with the main rib and the spacecraft to move the reflector between a collapsed and stowed configuration proximate the spacecraft and an open and deployed configuration outside the spacecraft. The storage profile is sufficiently slim to permit launching of a 6–25 meter diameter reflector attached to a full-sized spacecraft on one or more commercially available launch vehicles without the need for mid-rib hinges. A feed assembly is connected to the spacecraft. The feed assembly is offset from and operable with the mesh member of the reflector when the reflector is in the opened and deployed configurations to receive and/or transmit radio frequency energy therefrom.

28 Claims, 8 Drawing Sheets

9
10
11
12
13
17
18
24
68
78
80
90
92
94
95
96
97
98a
98b
98c
98d
99

EDGE-SUPPORTED UMBRELLA REFLECTOR WITH LOW STOWAGE PROFILE

CROSS-REFERENCE TO RELATED APPLICATIONS

The present application is related to U.S. patent application Ser. No. 08/888,487, entitled "A Continually Adjustable Nonreturn Knot," attorney docket No. PD-970125, U.S. patent application Ser. No. 08/888,486, entitled "Mesh Tensioning, Retension And Management Systems For Large Deployable Reflectors," attorney docket No. PD-960515, U.S. patent application Ser. No. 08/888,485, entitled "High-Torque Apparatus and Method Using Composite Materials For Deployment Of A Multi-Rib Umbrella-Type Reflector," attorney docket No. PD-970182, and U.S. patent application Ser. No. 08/888,500, entitled "Apparatus And Method For Combined Redundant Deployment And Launch Locking Of Deployable Satellite Appendages," attorney docket No. PD-960507. The present application and the four related applications, which are incorporated herein by reference, were filed with the U.S. Patent Office on the same day.

TECHNICAL FIELD

The present invention relates to deployable satellite reflector antennas, and more particularly, to an edge-supported collapsible mesh type reflector antenna of the type launched and sustained in space.

BACKGROUND ART

High gain antenna reflectors have been deployed into space for several decades. The configurations of such reflectors have varied widely as material science has developed and as the sophistication of technology and scientific needs have increased.

Large diameter antenna reflectors pose particular problems during all phases of their existence, whether it is assembly, stowage, launch, deployment and/or usage. Double-curved, rigid surfaces which are sturdy when in a deployed position cannot be easily folded for storage. Often, reflectors are stored a year or more in a folded, stowed position prior to deployment. In an attempt to meet this imposed combination of parameters, large reflectors sometimes have been segmented into petals so that these petals could be stowed in various overlapping configurations. However, the structure required in deploying such petals has tended to be rather complex and massive, thus reducing the practical feasibility of such structures. For this reason, dish-shaped antenna reflecting surfaces larger than those that can be designed with petals typically employ some form of a compliant structure.

Responsive to the need for such a compliant structure rib and mesh designs have been supplied and utilized. A network of tensioned radial and circumferential chords divides the mesh into substantially flat facets. The effect on the reflector performance caused by the difference in shape between these flat facets and the true parabolic surface is referred to as the faceting error. Prior art mesh reflector designs require the use of numerous facets because the circumferential and angular spacing between the ribs and the mesh attachment locations are not optimized to minimize the faceting error.

Other antenna designs typically include a center post about which the petals are configured, much like an umbrella configuration. This also affects the reflective quality of the resulting surface, because the center portion typically is the point of optimum reflectance, which is often blocked by the center post. Thus, it is desirable to have a structure that is deployable from a compact, stored position to an open dish-shaped position without center post blockage.

More recently, many rigid antenna reflectors have been constructed from graphite fiber reinforced, plastic materials (GFRP). Such materials may satisfy the requirements for space technology and contour accuracy and, therefore, high performance antenna systems. However, power and performance of rigid antennas are limited, owing to the size of the payload space in a launch vehicle. Very large completely rigid antennas are highly impractical to launch into space, hence the requirements for practical purposes can be satisfied only when the antenna is of a collapsible and foldable construction.

At present, antenna reflectors of the collapsible and foldable variety are of two design types. One type is a grid or mesh-type reflector that is folded like an umbrella. The other type includes foldable rigid and hinged petal members. Antennas of the second type are available in a variety of configurations, some of which are disadvantaged by the requirement for an excessive number of joints and segment pieces which, owing to the particular folding and collapsing construction, are of different shape and size. Also, the larger the number of hinges and segments, the more complex will be the deployment mechanism and its operation. Any added weight also is a disadvantage relative to a satellite system.

For a given paraboloid reflector diameter, the number of ribs used determines the width of each mesh singly-curved gore. Thus, more ribs result in more and narrower mesh gores, with each narrower gore being a better approximation of the ideal paraboloid shaped gore.

While the existing paraboloid reflectors are satisfactory to some degree, they have several inherent disadvantages which detract from their usefulness. Among the foremost of these disadvantages are excessive weight, excessive stowage volume requirements, excessive cost and complexity, inadequate surface accuracy, and inadequate deployment reliability.

SUMMARY OF THE INVENTION

Accordingly, it is an object of the present invention to provide an improved umbrella-type reflector having a low stowage profile. It is also an object of the present invention to provide a mesh-type, dish-shaped reflector which is an improvement over known mesh-type reflectors.

It is another object of the present invention to provide an edge-supported mesh-type umbrella reflector having a main rib supported by a boom on a spacecraft. It is still another object of the present invention to provide an edge-supported umbrella reflector which may be fed by an offset feed assembly.

It is still yet another object of the present invention to provide a mesh-type edge-supported umbrella reflector having a main rib and a plurality of secondary ribs each connected to a hub assembly by a single hinge without additional mid-rib hinges. It is a further object of the present invention to provide an edge-supported umbrella reflector having a mesh member attached to the ribs and uneven circumferential spacing between the ribs to minimize the faceting error of the reflector.

It is still a further object of the present invention to provide an edge-supported umbrella reflector having uneven radial spacing between the attachment points of the mesh to minimize the faceting error of the reflector. It is still yet a further object of the present invention to provide a mesh-type edge-supported umbrella reflector having hinge axis orientations for the ribs optimized to effect the tightest possible folding to achieve a low stowage profile.

In carrying out the above objects and other objects, features, and advantages of the present invention, a mesh-type umbrella-like reflector for use on an orbiting spacecraft is provided. The reflector has a contoured main rib and a plurality of contoured secondary ribs each connected to a hub assembly by a respective hinge such that activation of the hub assembly causes the reflector to move between collapsed and opened configurations. The mesh member is attached to the ribs. A deployment boom connects the main rib of the reflector to the spacecraft. The deployment boom is operable with the main rib and the spacecraft to move the reflector between a stowed configuration proximate the spacecraft and a deployed configuration outside the spacecraft.

A feed assembly is connected to the spacecraft. The feed assembly is offset from and operable with the mesh member of the reflector when the reflector is in the opened and deployed configurations to receive and/or transmit radio frequency energy therefrom.

The advantages of the present invention are numerous. For example, the reflector stowed profile is sufficiently slim to permit the stowage of a reflector up to twenty-five meters in diameter attached to a full-sized spacecraft (via two or more clam-shell type deployable clamps) on one or more commercially available launch vehicles. These and other features, aspects, and embodiments of the present invention will become better understood with regard to the following description, appended claims, and accompanying drawings.

BEST MODES FOR CARRYING OUT THE INVENTION

Figure 1:
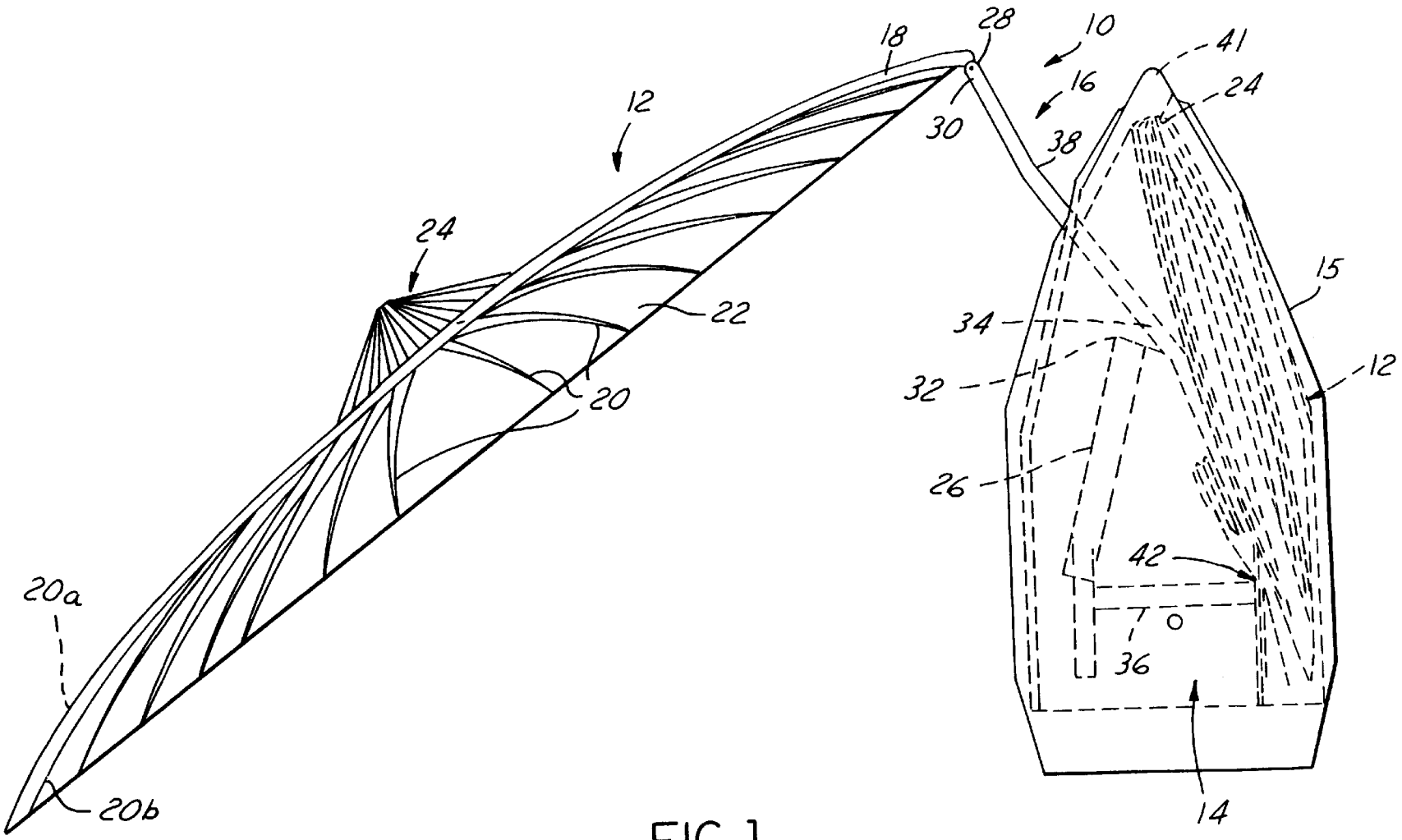
FIG. 1 illustrates the overall arrangement of a preferred embodiment of the mesh-type edge-supported umbrella reflector of the present invention.

Referring now to FIG. 1, an edge-supported umbrella reflector assembly 10 of the present invention is shown. Umbrella reflector assembly 10 includes a reflector 12 connected to a spacecraft 14 by a relatively stiff deployment boom 16. Reflector 12 is shown in FIG. 1 in a deployed configuration and shown in dashed lines in a stowage configuration within a booster payload fairing 15. Reflector 12 may have a diameter ranging from six to twenty-five meters. FIG. 1 shows a 15×12.3 meter reflector in a mid-sized booster fairing.

Figure 1A:
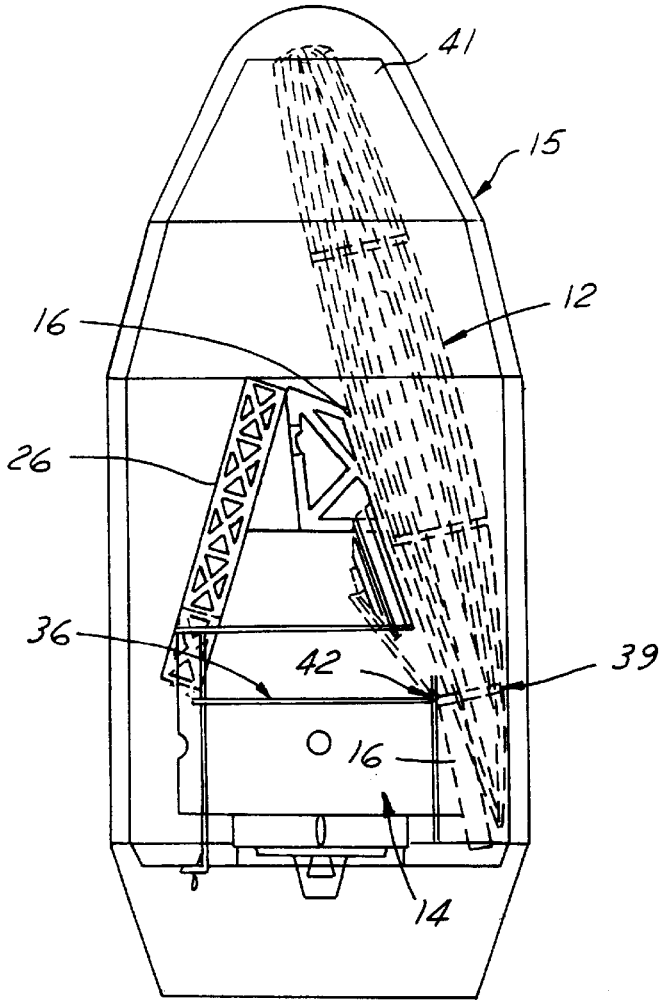
FIG. 1A illustrates the edge-supported umbrella reflector in a stowed configuration within a booster payload fairing of a spacecraft.

FIG. 1A illustrates reflector 12 in a stowed configuration within booster payload fairing 15. Booster payload fairing 15 shown in FIG. 1A is a Long March III-B fairing.

Reflector 12 includes a main rib 18 and a plurality of secondary ribs 20. Boom 16 connects main rib 18 to spacecraft 14. Main rib 18 has a torque box construction and contoured edges and is connected to boom 16 to provide an "edge-support" for reflector 12. Secondary ribs 20, which are described in more detail below, are of a light weight planer-truss construction and are contoured and tapered toward their outer edges.

Attached to main rib 18 and secondary ribs 20 is a mesh 22 which acts as a reflecting surface. Reflector 12 further includes a hub assembly 24. Hub assembly 24 is connected to main rib 18 and secondary ribs 20 and assists in moving the ribs between the deployed and stowed configurations. A feed assembly 26 on spacecraft 14 is operable with reflector 12 to transmit and/or receive radio frequency (RF) energy therefrom. Feed assembly 26 is offset from the edge of reflector 12 thus avoiding self blockage by the feed assembly of the reflected antenna RF energy.

A first deployment actuator 28 connects a top end 30 of boom 16 to main rib 18. A second deployment actuator 32 connects a bottom end 34 of boom 16 to spacecraft 14. Deployment actuators 28 and 32 are preferably of the conventional viscous damped spring actuator type.

To minimize the width of reflector 12 at the critical location in the spacecraft payload compartment, shown by reference numeral 39 in FIG. 1A, where the stowed reflector passes between one edge 42 or spacecraft shelf 36 and booster payload fairing 15, the deployment boom is kinked at that location as shown by reference numeral 38.

A pair of secondary ribs 20*a* and 20*b* generally opposite of main rib 18 are spaced apart when stowed to permit the passage and nesting of boom 16 between them on the same plane and opposite to the main rib. In FIG. 1, rib 20*a* falls directly behind rib 20*b* due to symmetry and is not specifically shown in the Figure. The number of secondary ribs 20 is an even number such that the total number of ribs 18 and 20 (and thus the number of triangular reflector gore segments) is an odd number. Thus, none of secondary ribs 20 falls directly opposite main rib 18, where boom 16 stows.

Figure 2:
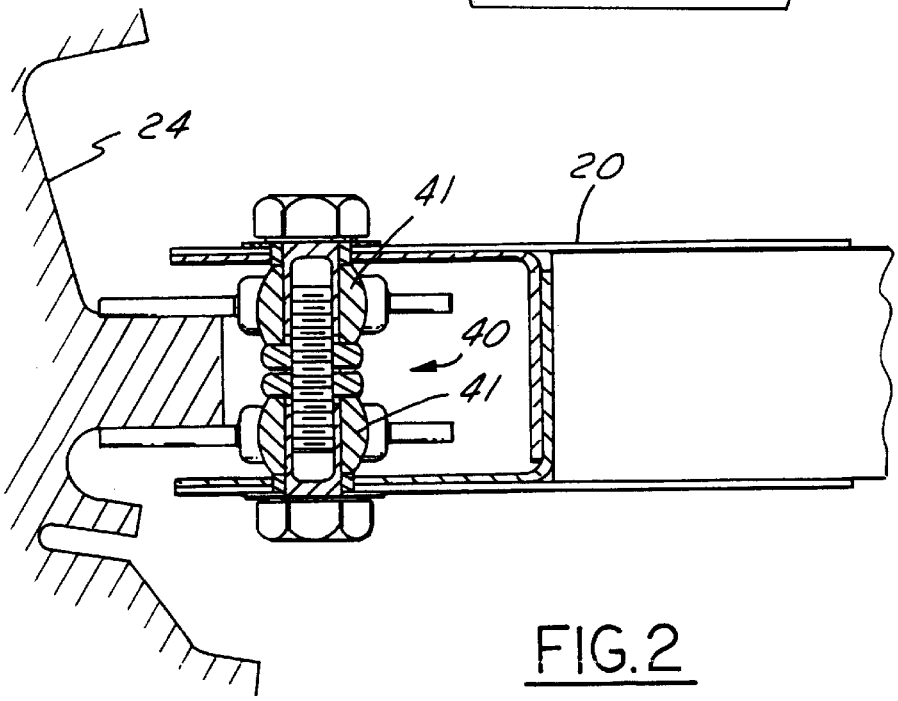
FIG. 2 illustrates a hinge connecting a rib to a hub assembly.

FIG. 2 illustrates the connection of a rib such as secondary rib 20 to hub assembly 24. Each of ribs 18 and 20 is connected by a single hinge to hub assembly 24. For instance, as shown in FIG. 2, hinge 40 attaches secondary rib 20 to hub assembly 24. The hinges are designed to be zero-clearance (pre-loaded) hinges. The hinge construction shown is aimed at minimizing the center spacing between the hinges, and thus the diameter of hub assembly 24, while permitting rib assembly and disassembly. The small hub diameter (about 4% of the reflector diameter) permits stowage of reflector 12 in the often unused volume near the top 41 of booster payload fairing 15.

The hinge axis orientations for each of the ribs are individually optimized to effect the tightest possible folding thus minimizing the width of reflector 12 where the reflector passes between spacecraft corner 42 and the booster payload fairing 15 without significantly compromising the width of the reflector in the orthogonal direction. The orthogonal direction is the direction perpendicular to the view shown in FIG. 1.

Figure 3A:
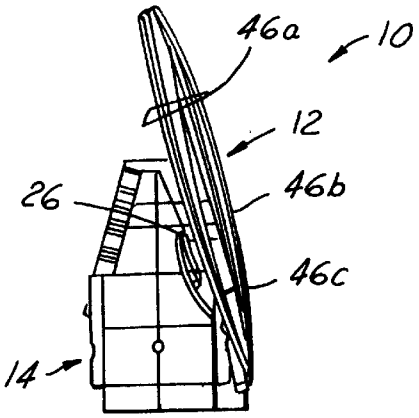
FIGS. 3*a*–3*d* illustrate the deployment sequence of the edge-supported umbrella reflector.

Referring now to FIGS. 3*a*–3*d*, the deployment sequence which reflector 12 performs on orbit to transition from the stowed launch configuration to the operational deployed configuration is shown. FIG. 3*a* illustrates reflector 12 in the stowed and launch configurations. A plurality of stowage clamps 46(*a*–*c*) hold reflector 12 to spacecraft 14. Stowage clamps 46(*a*–*c*) include pyrotechnic devices (e.g., bolt cutters or separation nuts) to lock and release the stowage clamps as will be explained later with reference to FIG. 4.

Figure 3B:
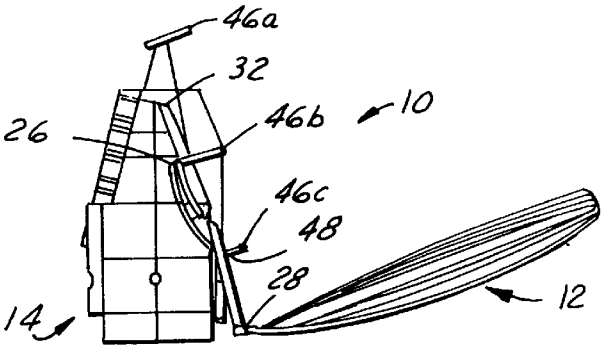

During the first motion of deployment shown in FIG. 3*b*, pyrotechnic devices on stowage clamps 46(*a*–*c*) are released permitting the activation of first deployment actuator 28 connecting main rib 18 to boom 16. First deployment actuator 28 causes reflector 12 to move away from spacecraft 14 as shown in FIG. 3*b*.

Figure 3C:
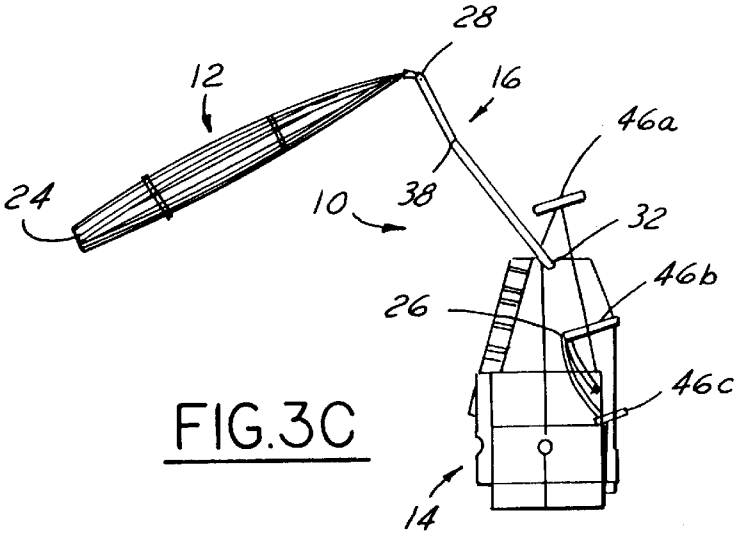

During the second motion of deployment shown in FIG. 3*c*, a launch lock 48 attaching a point near the kink location 38 of boom 16 to lower stowage clamp 46*c* is released. Correspondingly, second deployment actuator 32 connecting bottom end 34 of boom 16 to spacecraft 14 is activated. Second deployment actuator 32 causes reflector 12 to move up and around spacecraft 14 as shown in FIG. 3*c*. As can be seen, this motion passes boom 16 through the upper stowage clamp 46*a* which is facilitated by the particular design of the clamp to be discussed in relationship to FIG. 4.

Figure 3D:
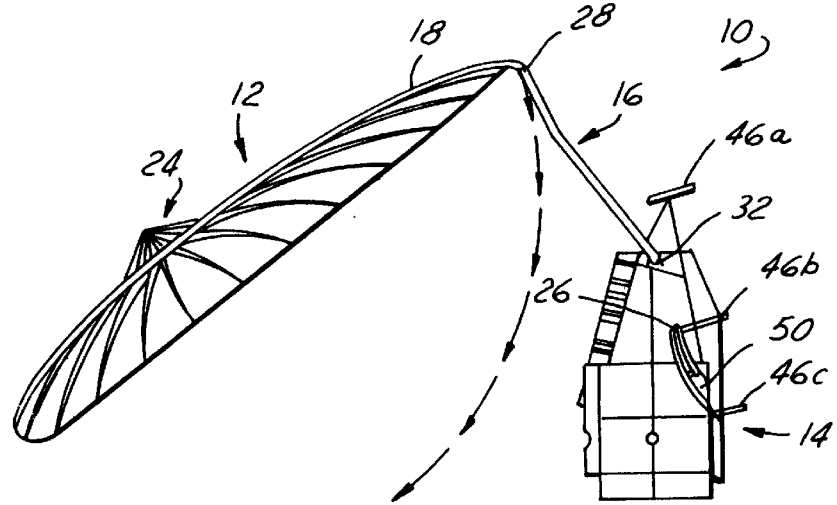

FIG. 3*d* depicts reflector 12 in the operational deployed configuration. To achieve the deployed configuration from the second motion of deployment shown in FIG. 3*c*, hub assembly 24 is activated to force ribs 18 and 20 open relative to hub assembly 24 as will be explained in greater detail with reference to FIG. 5. Accordingly, in the deployed configuration, reflector 12 is operational with offset feed assembly 26 to transmit and/or receive RF energy therefrom. If desired, a second reflector assembly 50 on spacecraft 14 may be employed for a different frequency band in addition to reflector 12.

Figure 4A:
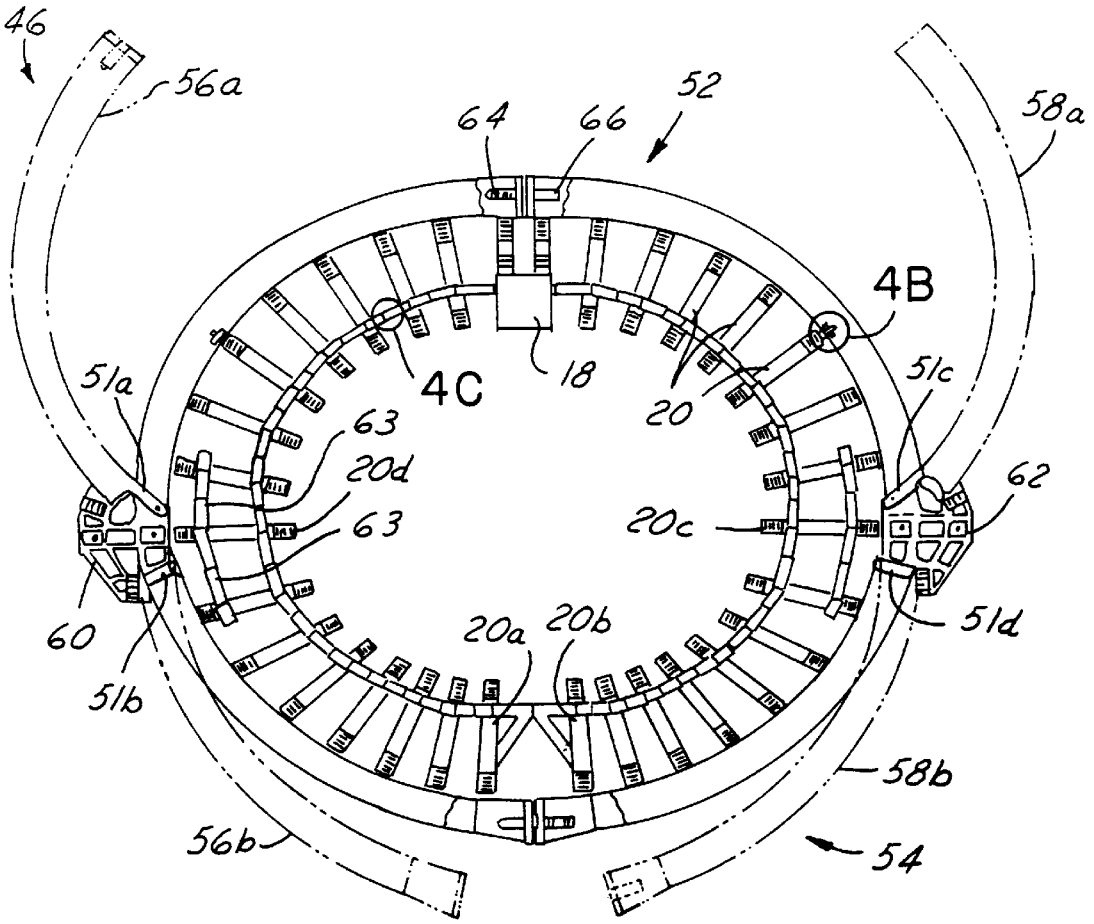
FIGS. 4*a*–4*c* illustrates an exemplary launch constraint clamp.
Figure 4B:
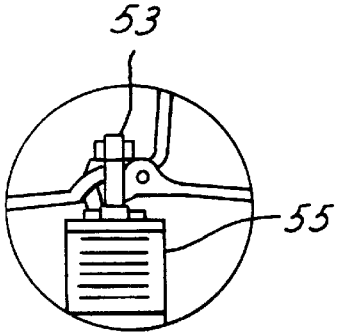
Figure 4C:
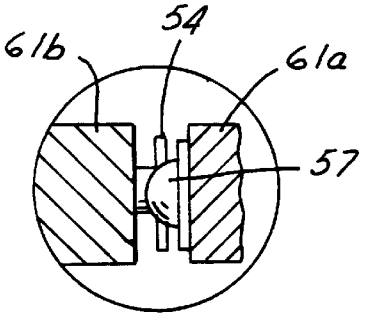

FIG. 4 illustrates an exemplary stowage device 46. The stowage device 46 is double acting with both front half 52 and back half 54 deployable in order to permit passage of boom 16 through the stowage device during the second motion of deployment described above. Front half 52 and back half 54 includes respective arms 56(*a*–*b*) and 58(*a*–*b*). Arms 56(*a*–*b*) and 58(*a*–*b*) are pivotable about a respective hinge assembly 51(*a*–*d*) with an associated crushable/catcher fixture assembly 60 and 62. Arms 56*a* and 58*a* are connected by a separation bolt having a bolt cutter 64 and a bolt catcher 66. The separation bolt is releasably engaged to allow arms 56*a* and 58*a* to open. Release is accomplished via bolt cutter 64 which is pyrotechnically operated using small explosive charges to sever the separation bolt upon ground command. Other pyrotechnic devices such as separation nuts may be used alternatively to perform this function. Arms 56*b* and 58*b* are similarly arranged.

Arms 56 and 58 include adjustable screws 53 having hemisperical heads which engage dry lubricated metallic washers with sperical indentations 55 bonded (or otherwise attached) to each of secondary ribs 20 and main rib 18. Additionally, at the stowage device locations, ribs 18 and 20 are spherically rotatably engaged to each other using pairs of male spherical protrusions 57 and dry lubricated female washers with sperical indentations 59 attached to the ribs via light weight stand offs (61*a*,*b*). In certain locations, it may not be practical (or desirable) to have a direct connection between the stowage device and ribs 20, as is the case with ribs 20*c* and 20*d* where such an attachment may impede deployment (because the stowage device at these locations does not move). For such ribs, additional sets of spherical attachments 57, 59 connecting ribs 20(*c*–*d*) to their neighborhing ribs at locations marked 63 are used instead of connections to the stowage device.

Figure 5B:
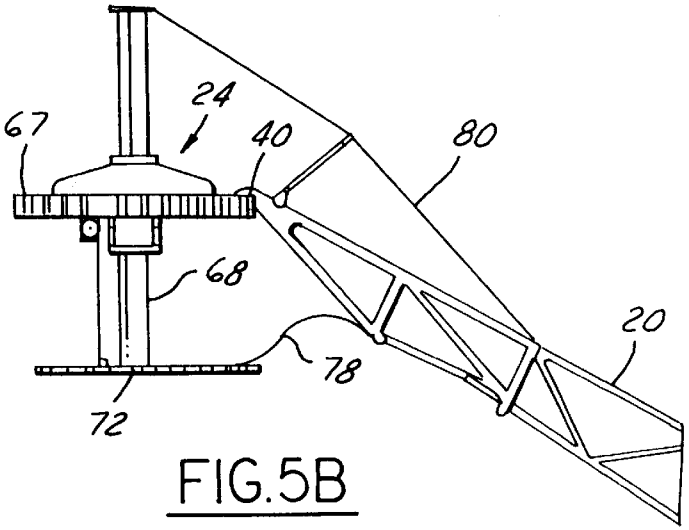
FIGS. 5*a*–5*c* illustrate the deployment sequence of the hub assembly.
Figure 6:
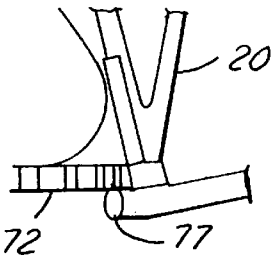
FIG. 6 illustrates the hub assembly restraining a secondary rib against deployment.
Figure 5A:
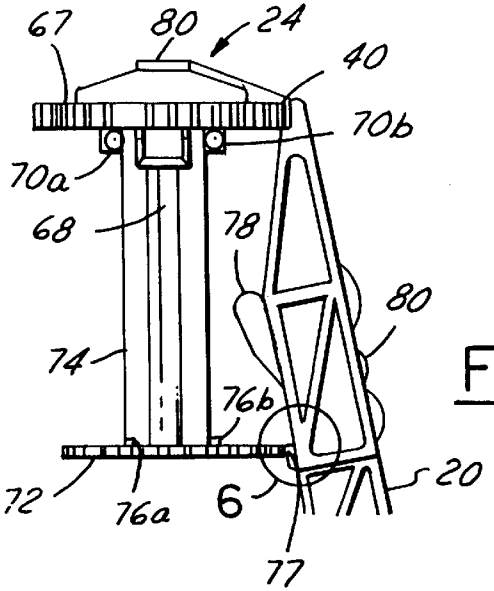
Figure 5C:
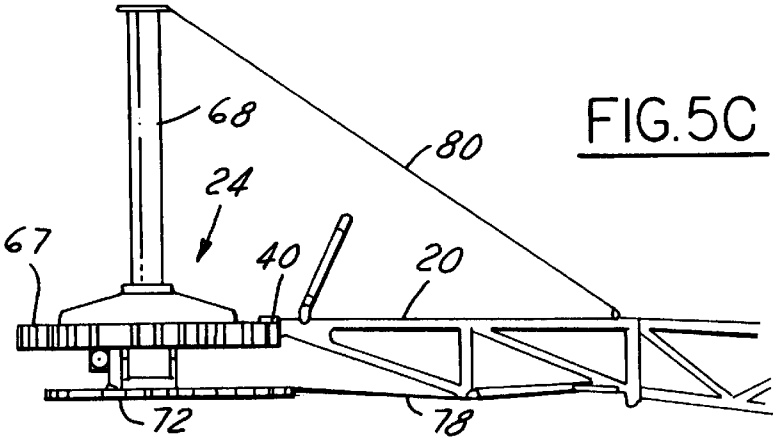

Referring now to FIGS. 5*a*–5*c*, deployment of hub assembly 24 to move reflector 12 into the deployed configuration is shown. Hub assembly 24 includes a hub 67. A shaft 68 and two stepper motors 70(*a*–*b*) are connected to hub member 67. Hub assembly 24 further includes a base plate 72. A motor strap 72 wraps around pullies 76(*a*–*b*) connected to base plate 72 and connects at its two ends to pullies mounted to respective stepper motors 70(*a*–*b*). In the stowed configuration shown in FIG. 5*a*, base plate 72 restrains secondary rib 20 against deployment by engaging the secondary rib through a shear code 77 shown in greater detail in FIG. 6.

Secondary rib 20 is connected to hub member 67 by hinge 40. A lower heavy GFRP strap 78 connects secondary rib 20 to base plate 72. A relatively flexible upper strap 80 connects secondary rib 20 to shaft 68 above hub 67. Deployment of reflector 12 is effected by activating either or both of stepper motors 70(*a*–*b*) operatively with motor strap 74, pullies 76(*a*–*b*), and base plate 72 to redundantly slowly drive shaft 68 upwards through hub 67. As shaft 68 travels upwards, upper strap 80 pulls on secondary rib 20 causing it to extend away from hub assembly 24 as shown in FIG. 5*b*. When shaft 68 is in a fully deployed position extending above hub 67, base plate 72 is completely behind the theoretical reflector surface and reflector 12 is in the deployed configuration shown in FIGS. 1 and 5*c*.

Deployment of reflector 12 and hub assembly 24 is terminated by the engagement of at least one of two redundant spring-loaded detents into holes located in shaft 68 such that they line up with the detents when reflector 12 is in the deployed configuration (not specifically shown). It should be noted that while in FIGS. 5*a*–5*c* and in the discussion above, hub member 67 is represented as stationary with ribs 20 and shaft 68 moving relative to it. In reality, hub member 67 rotates approximately 90 degrees during the phase of deployment as can be seen from comparing FIGS. 3*c* and 3*d*. This slow rotation is a rigid body motion and does not affect the kinematics of deployment nor the relative motions between the various components described above.

Hub assembly 24 is capable of slowly controlled (non-dynamic), reversible deployment in 1-G environment without off loading (except for main rib 18) initiated without irreversible pyrotechnic events. Hub assembly 24 incorporates all moving parts into a compact separately testable assembly, thus maximizing deployment reliability and testability.

Figure 7:
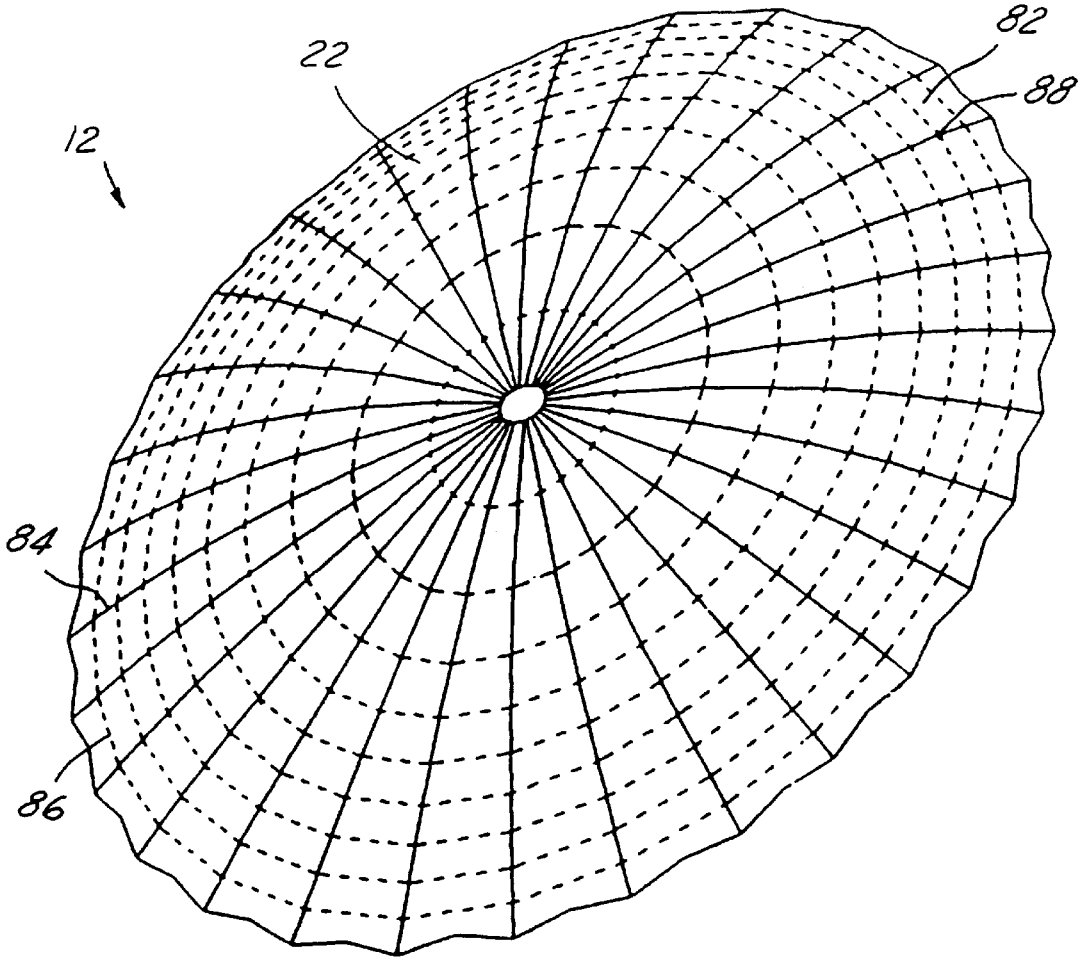
FIG. 7 illustrates the mesh layout of the edge-supported umbrella reflector.
Figures 8, 9, 10, 11, 12, 13:
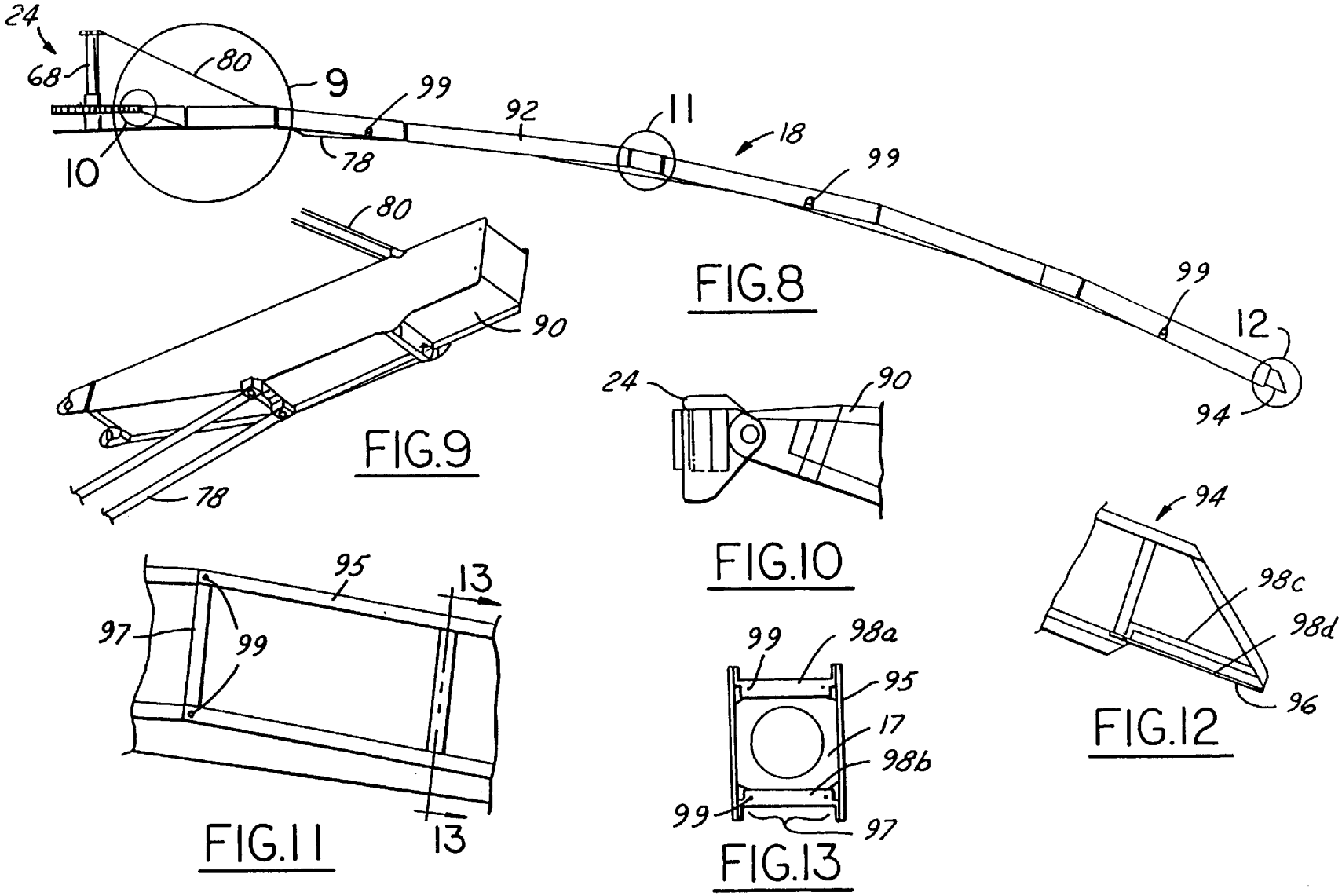
FIGS. 8–13 illustrate the construction of the main rib.

FIG. 7 illustrates the layout of mesh member 22 on reflector 12. Mesh member 22 is divided into a plurality of trapezoidal-shaped facets 82 by a network of pre-tensioned Kevlar or Vectran radial chords 84 and circumferential chords 68. Chords 84 and 86 are constructed on the focus side (towards feed assembly 26) of mesh member 22. Mesh 22 is thus divided into substantially flat facets 82. Mesh 22 is attached to ribs 18 and 20 only at corners 88 of facets 82. In short, mesh 22 is attached at radial attach points running along ribs 18 and 20. The effect on the performance of reflector 12 caused by the difference in shape between flat faces 82 and the true parabolic surface is referred to as the faceting error.

For a given diameter of reflector 12, the number of reflector ribs is chosen to limit the faceting error to an acceptable value. In the present invention, the faceting error resulting from a given number of ribs, or conversely, the number of ribs required to limit the faceting error to a given level, is further optimized by three characteristics.

First, the circumferential spacing between adjacent ribs 18 and 20 is varied across reflector 12. For reflector 12 fed by offset feed assembly 26, the vertex of the reflector is near the outer end of main rib 18 where it connects to first deployment actuator 28. The curvature of reflector 12 is the highest nearest the vertex. Accordingly, main rib 18 and adjacent secondary ribs 20 have a higher curvature than secondary ribs 20 farthest away from the vertex. Pair of secondary ribs 20(*a–b*) opposite from main rib 18 have the lowest curvature. The circumferential spacing between the rib tips is reduced for the ribs nearest the vertex and gradually increases as the ribs extend to the opposite end near ribs 20(*a,b*). Thus, secondary ribs 20(*a–b*) have the largest angular spacing and secondary ribs 20 adjacent on each side of main rib 18 are spaced from the main rib with the smallest circumferential spacing. The purpose of using uneven spacing between ribs 18 and 20 is to approximately equalize the normal distance between the outermost circumferential chords and the parabolic surface.

Second, the number of radial attachment points of mesh member 22 along ribs 18 and 20 are appropriately selected. For instance, it can be shown that if the objective is to minimize the total number of radial attachment points then the optimum number of radial attachment points is equal to the number of ribs divided by ($\pi$ multiplied by the square root of 2):

$$\frac{N_R}{\pi\sqrt{2}}$$

However, because the number of radial attachment points has significantly less impact on cost and weight of reflector 12 than the number of ribs, the number of radial attachment points is selected to be at least equal to the number of ribs divided by $\pi$.

Third, the radial spacing between the radial attach points along ribs 18 and 20 decreases as the circumference of reflector 12 increases. Because the faceting error is proportional to the area of the facet multiplied by the square of the maximum distance from the facet to the parabolic surface and by the power density of the feed illumination (B), optimum spacing between the radial attach points is achieved when the quantity $(W*L*(W^2+L^2)^2*B)$ is approximately equal for all facets. W and L are the average width and length of a facet, respectively. The phase relationships between the various radiating feed elements of feed assembly 26 are also optimized to minimize the faceting errors.

Referring now to FIGS. 8–13, the construction of main rib 18 is shown. Main rib 18 consist of two portions. Namely, inner main rib 90, which starts out as part of hub assembly 24, and outer main rib 92. Ribs 90 and 92 each have a bonded built-up box beam cross-section and is fabricated primarily from GFRP plates, angle members, and channel members. Outer main rib 92, including its integral end fitting 94 is fabricated primarily from only two different thickness plates 95 and 96, one channel member 97, and four different size angle members 98(*a–d*). The curved reflector contour of outer main rib 90 is provided by numerically controlled (N/C) machining of the side plates to the required profile. Tooling holes 99 are provided in the side plates and near the ends of each channel and angle to aid in assembling main rib 18.

Figure 14:
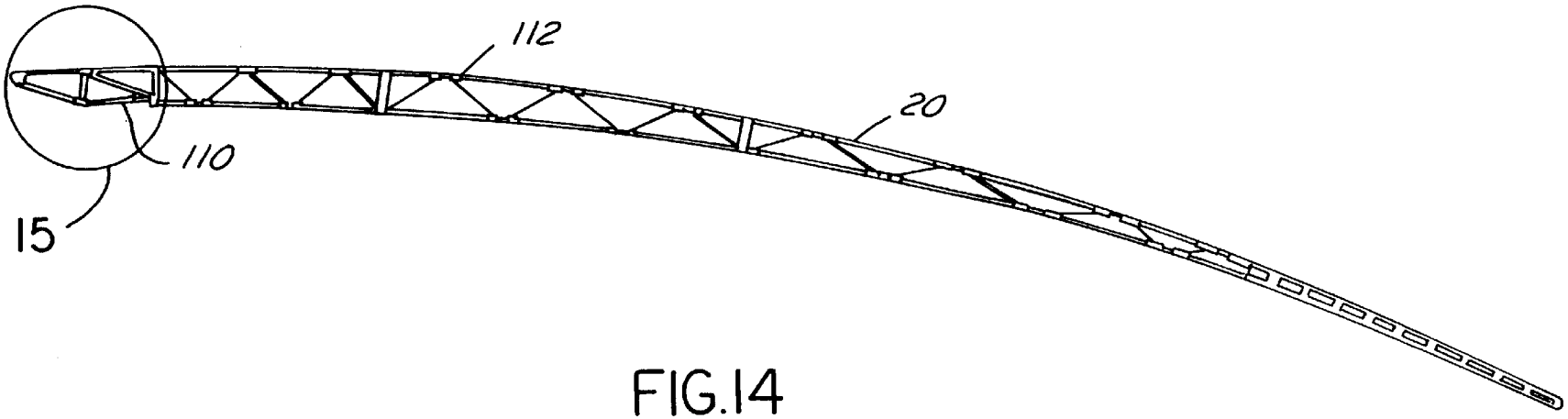
FIGS. 14–15 illustrate the construction of one of the secondary ribs.
Figure 15:
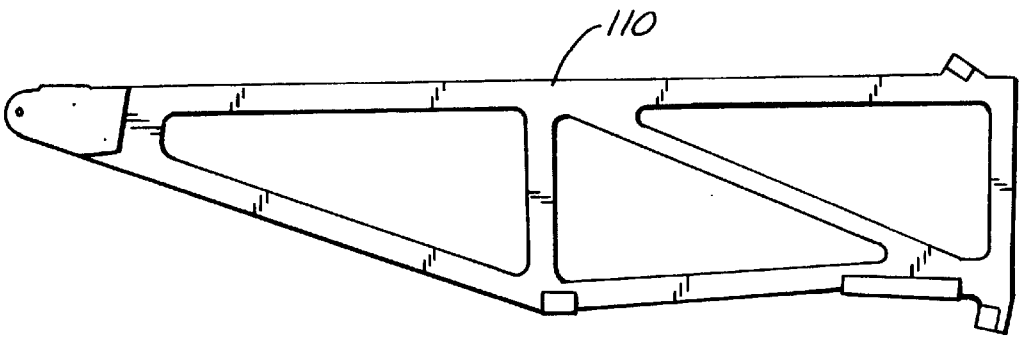

Referring now to FIGS. 14 and 15, the construction of one of secondary ribs 20 is shown. Secondary rib 20 consists of an inner secondary rib 110, which is a part of hub assembly 24, and an outer secondary rib 112. Because there is a relatively large number of secondary ribs, they account for the largest single weight item of reflector 12. It is therefore important to design the secondary ribs with a low cost, light-weight structure. Specifically, secondary rib 20 has a planar truss (frame) shape N/C machined (or waterjet cut) from a large honeycomb sandwich plate. The sandwich plate has thin GFRP facesheets and a non-metallic core made of Nomex, Corex or Kevlar. Depending on the size of reflector 12 and the machining facility available, outer secondary rib 112 is made out of one to three segments spliced together using small bonded GFRP doubler plates with the aid of simple flat tooling with indexing tooling holes/pins. This approach minimizes fabrication time and tooling cost, permits maximum flexibility for rib weight optimization, and provides an accurate contour shape. The absence of mechanical joints (except for the one preloaded hinge per rib) and the minimum number of bonded joints makes for a highly predictable structural and thermo-structural behavior for reflector 12.

Due to the extremely favorable specific strength and stiffness characteristics, as well as their low coefficient of thermal expansion (CTE), composite materials make up over 98% of the volume of reflector 12. Stepper motors 70(*a–b*) account for more than half the weight of the tiny amount of metallic materials used, with the remainder of the weight confined to small components such as fasteners, monoballs, bushings, etc., which have no detrimental effect on thermal distortion.

For weight and material cost efficiency, the choice of the type of graphite fiber used for secondary ribs 20 is important. Because the design is generally stiffness and/or stability driven, the cost per unit stiffness is the most significant parameter in order to minimize cost. The specific compressive stiffness is the preferred measure for stiffness and stability efficiency. Ultra-high modulus Graphite fibres of Toray Industries, Inc. designated as M55J, have a low cost per unit stiffness. Ultra-high modulus Graphite fibres of Nippon Graphite Fibre corporation designated as XN70 have a high specific compressive stiffness. Accordingly, M55J is preferably used for the construction of secondary ribs 20 because it has a specific compressive stiffness of 85% of that of XN70 at less than half the cost per pound, as well as significantly higher strength.

The present invention provides a reflector assembly having maximized deployment reliability and performance with minimum cost. High surface accuracy resulting in high reflector performance is enhanced by two general features. First, enhanced deployment repeatability and second, minimum thermal distortion.

Deployment repeatability is enhanced by two specific features. First, pre-loaded monoballs or ball bearings 41 are used to form the rib/hub hinges 40. Hinges 40 are further pre-loaded by use of two sets of deployment straps 78 and 80 which results in a repeatable hinge contact point regardless of the magnitude of the tension in either strap. This enhances repeatability by eliminating the effect of hinge sloppiness on the deployed shape.

Second, mechanical contact-type deployment stops are eliminated. Instead, heavy GFRP straps 78 permanently connecting ribs 18 and 20 to base plate 72 are used as the stops. Straps 78 have very high axial stiffness and very low CTEs. In contrast, conventional mechanical stops are often metallic (high CTE), may exhibit local yielding (thus have low apparent stiffness), and may contact at slightly different points at successive deployments resulting in shape changes (non-repeatability in deployment).

Thermal distortion is minimized by these specific techniques. First, the choice of the composite lay-ups is selected consistent with the type of graphite fiber used. The result is very low CTEs in the range of +0.05 to −0.20 ppm/degree F. The addition of minor amounts of adhesive, foam fill, and/or metallic fasteners/inserts, result in effective CTEs in the range of +0.1 to −0.2 ppm/degree F., which in turn minimizes thermal distortion.

Second, thermal blankets are positioned around ribs 18 and 20 and boom 16. The thermal blankets reduce the gradient through the thickness and across the depth of the ribs and the boom further reducing the thermal distortion. The blankets, which are designed to be fabricated using pressure sensitive adhesive rather than Velcro tape, serve the additional function of protecting mesh member 22 from possible snagging on exposed honeycomb core edges or fastener heads.

Third, the effect of the relatively high mesh CTEs is rendered negligible by the use of an extremely low stiffness tricot knit. The effect of the moderately low CTE and moisture sensitivity of the Kevlar mesh retension chords is also rendered negligible by the use of soft springs in series with each of these chords.

High deployment reliability and low cost is also achieved by other general features. First, reflector 12 is deployable in one-G without the need for off-loading ground support equipment (GSE). Only main rib 18 is off-loaded using dead weights and pulleys hanging from a crane or by using a helium-filled balloon. This avoids the expense, facility limitation, and errors and uncertainties induced by a huge multitrack off-loader system. The high capability deployment system required to accomplish the task in 1-G will provide a high deployment margin in zero-G. In addition to the increased deployment system capability, the 1-G deployability is made possible by the highly efficient rib structural design (high stiffness, super lightweight trussed graphite honeycomb) and the ultra lightweight mesh and mesh restraint chords utilized.

Second, slow (non-dynamic), motorized, and reversible deployment by hub assembly 24 without pyrotechnic initiation results in significant reliability and cost advantages. These provide the ability to overcome deployment hang ups by backing up the motors for a certain distance and then re-deploying. This minimizes or eliminates the need for expensive dynamic deployment analysis and its associated uncertainties. The invention is also deployable in ambient 1-G environment (no air drag effect or gravity/off loader induced drag error during ground testing), without any pyroshock, pyro refurbishment, or associated adverse reliability impact.

Third, soft tooling integration concept produces high surface accuracy at low cost. The soft tooling integration concept eliminates the cost and facility requirements associated with large tooling required for typical spacecraft reflectors of the prior art. The soft tooling integration concept involves several steps labeled A–G in the following paragraphs.

A) Each outer rib is supported in a kinematic fashion (at a total of six degrees of freedom) at two locations and optically aligned in its theoretical position. The location of the two support points for each rib is selected to minimize the rib tooling point deflections and the rotation of the inner end of the outer rib where it will be subsequently spliced to the inner rid due to 1-G loading.

B) In defining the outer rib contours, the profiles are cut back relative to the theoretical parabolic shape by the deflections predicted to be caused by the nominal mesh and mesh retaining chord pre-loads for a case where the ribs are fixed at the interface points between the inner and outer ribs. The error associated with the uncertainty in this process is minimized by designing the ribs to be particularly stiff in their own planes (which is also needed in order to handle 1-G deployment and launch loads).

C) The hub/inner rib assembly is optically aligned to its theoretical position while supported on a stiff adjustable stand.

D) The outer edges of the inner ribs are loaded with a set of pre-calibrated tension springs and moment arms. These loads represent the forces and moments predicted to be caused by the nominal mesh and mesh retaining chord pre-loads.

E) After alignment, the outer ribs are spliced to the inner ribs via field splice joints injected with adhesive and syntactic foam which act as liquid shims to fill any gaps in the joints between the edges of the inner and outer ribs without appreciably stressing them.

F) Mesh and mesh retension chords are installed and tensioned to their desired levels.

G) Reflector contour is measured (including 1-G compensation/off-loading) and final contour adjustments are made if necessary. Adjustments are made either by slight changes in mesh retension chord tensions, and/or hub strap tensions. Contour measurements are then repeated and so on until contour shape is satisfactory.

A 40'×50' (12.3 meter projected aperture) engineering development model reflector utilizing the teachings of the present invention was designed, built and tested. Photogrammetric surface measurements were taken showing that the reflector met the as-built RMS goal of 1 mm. Three successful deployment demonstrations were performed (two prior to vibration testing and one post-vibration testing). Moreover, a protoflight level sine vibration test was performed with the reflector supported on a spacecraft simulation fixture and successfully completed as indicated by a post-test functional deployment and surface measurement demonstration.

It should be noted that the present invention may be used in a wide variety of different constructions encompassing many alternatives, modifications, and variations which are apparent to those with ordinary skill in the art. Accordingly, the present invention is intended to embrace all such alternatives, modifications, and variations as fall within the spirit and scope of the appended claims.

What is claimed is:

1. For use on an orbiting spacecraft, a reflector antenna system comprising:

an umbrella-like reflector having a main rib and a plurality of secondary ribs each connected to a hub assembly by a respective hinge mechanism such that activation of the hub assembly causes the reflector to move between collapsed and opened configurations, the reflector further having a mesh member attached to said main rib and said plurality of secondary ribs;

a deployment boom connecting the main rib of the reflector of the spacecraft, wherein the deployment boom is operable with the main rib and the spacecraft to move the reflector between a collapsed and stowed configuration adjacent to the spacecraft and a deployed configuration away from the spacecraft, wherein the total number of ribs is an odd number such that the deployment boom can be positioned at least partially between a pair of secondary ribs situated opposite from the main rib when the reflector is in the collapsed and stowed configuration; and a feed assembly connected to the spacecraft, the feed assembly being offset from and operable with said mesh member of the reflector when the reflector is in the deployed configuration to transmit radio frequency energy therefrom.

2. The reflector antenna system of claim 1 further comprising two opposing hinge straps connecting each of said ribs to said hub assembly.

3. The reflector antenna system of claim 1 wherein said deployment boom is kinked to afford low profile stowage of the reflector in the collapsed and stowed configurations.

4. The reflector antenna system of claim 1 wherein the main rib consists of an inner main rib and an outer main rib spliced to said inner main rib.

5. The reflector antenna system of claim 1 further comprising a network of pretensioned radial and circumferential retention chords associated with said mesh member to resist the natural pillowing tendency of said mesh member.

6. The reflector antenna system of claim 5 wherein the circumferential spacing of the ribs varies from rib to rib to minimize mesh faceting errors.

7. The reflector antenna system of claim 5 wherein said mesh member is attached to the ribs at radial attachment points, wherein the spacing of the radial attachment points decreases as the circumference of the reflector increase to minimize mesh faceting errors.

8. The reflector antenna system of claim 1 wherein said hub assembly includes a stepper motor.

9. The reflector antenna system of claim 1 wherein the ribs are comprised of composite materials.

10. The reflector antenna system of claim 1 further comprising a plurality of stowage devices for holding the reflector in the collapsed and stowed configuration.

11. The reflector antenna system of claim 1 further comprising at least one clam-shell-type storage clamp for holding the reflector in the collapsed and stowed configuration.

12. The reflector antenna system of claim 11 wherein said storage clamp comprises a first set of spherical connectors positioned between each of said ribs and a second set of spherical connectors is positioned between each of said ribs and said storage clamp.

13. The reflector antenna system of claim 11 wherein said storage clamp comprises two sets of spherical connectors positioned between each of said ribs.

14. The reflector antenna system of claim 11 wherein said storage clamp is double-acting in order to permit said boom to pass therethrough during deployment.

15. The reflector antenna system of claim 1 wherein said mesh member is comprised of a plurality of substantially flat facets, the corners of said facets being aligned with said ribs.

16. An umbrella-like reflector assembly comprising:

an actuable hub assembly;

a main rib connected to said hub assembly by a hinge mechanism;

a plurality of secondary ribs each connected to said hub assembly by a respective hinge mechanism;

a mesh member attached to said main rib and said plurality of secondary ribs for providing a reflective surface; and a depolyment boom connecting said main rib of the reflector to a spacecraft, wherein said deployment boom is operable with said main rib to move the reflector between a collapsed and stowed configuration adjacent to the spacecraft and a deployed configuration away from the spacecraft;

wherein activation of said hub assembly causes the reflector to move between said collapsed and deployed configurations.

17. The reflector assembly of claim 16 wherein the orientations of said hinge mechanisms are different for each of said ribs such that the stowed width of the reflector is minimized to permit the reflectorto fit adjacent said spacecraft within the confines of the payload fairing.

18. The reflector assembly of claim 16 wherein said main and secondary ribs are contoured to fit the shape of the reflector.

19. The reflector assembly of claim 16 wherein said secondary ribs are truss-shaped.

20. The reflector assembly of claim 16 wherein said plurality of secondary ribs are fabricated from GFRP sandwich plates.

21. A method of forming the surface of a mesh reflector having a hub assembly and a plurality of ribs, wherein the plurality or ribs have an inner and an outer portion, the method comprising the steps of:

optically aligning the outer portions of each of said plurality of ribs;

optically aligning the hub assembly and inner portions of each of the plurality of ribs;

splicing the outer portions of each of the plurality of said ribs to the respective inner portions;

installing a mesh member over said ribs;

installing a network of tensioning chords to said mesh member; and attaching said mesh member to said ribs along radial attachment points on said ribs.

22. The method of claim 21 further comprising the steps of optically measuring the surface of the mesh reflector.

23. The method of claim 22 further comprising adjusting said mesh member until the surface of the mesh reflector is satisfactory.

24. The method of claim 21 further comprising the step of kinematically supporting each of said outer rib portions during alignment in a total of six degrees of freedom.

25. The method of claim 24 wherein two stand members are utilized to provide the kinematic support with the locations of the stands being optimized to minimize rotation of the inner ends of said outer rib portions where said inner and outer rib portions are to be spliced together.

26. The method of claim 24 wherein two stand members are utilized to provide the kinematic support with the locations of the stands being optimized to minimize deflection of the tooling points on the ribs used for alignment.

27. The method of claim 21 further comprising the step of preloading said inner rib portions at the time of splicing them to said outer rib portions, with forces and/or moments equivalent to the loads expected to be imparted to them in space by said outer rib portions when at least said mesh member is attached thereto and preloaded appropriately.

28. The method of claim 21 further comprising the step of reducing the contours of said ribs by an amount substantially equivalent to the predicted deflections expected to be imposed to them in space due at least to said mesh member.

* * * * *